US007555993B2

(12) United States Patent
Quinn et al.

(10) Patent No.: US 7,555,993 B2
(45) Date of Patent: Jul. 7, 2009

(54) PORTABLE MOORING SYSTEM

(76) Inventors: James Brian Quinn, 183 Main St., Ravena, NY (US) 12143; William Alden Starr, 116 Cannon Ave., Goose Creek, SC (US) 29445; Brian William Gallagher, 14 Jackson Ct., Guilderland, NY (US) 12084

( * ) Notice: Subject to any disclaimer, the term of this patent is extended or adjusted under 35 U.S.C. 154(b) by 0 days.

(21) Appl. No.: 11/958,464

(22) Filed: Dec. 18, 2007

(65) Prior Publication Data

US 2008/0141919 A1 Jun. 19, 2008

Related U.S. Application Data

(60) Provisional application No. 60/875,723, filed on Dec. 19, 2006.

(51) Int. Cl.
*B63B 21/04* (2006.01)

(52) U.S. Cl. ..... 114/230.11; 114/218

(58) Field of Classification Search ..... 114/218, 114/230.11, 230.15–230.19; D12/317; D8/355, D8/356

See application file for complete search history.

(56) References Cited

U.S. PATENT DOCUMENTS

| | | | | |
|---|---|---|---|---|
| D35,031 | S | 9/1901 | Schmidt | |
| 2,602,618 | A * | 7/1952 | Cohen | 43/21.2 |
| 3,108,563 | A | 10/1963 | Wurdack | |
| 3,120,831 | A | 2/1964 | Fulton | |
| 3,187,707 | A * | 6/1965 | Carbone | 114/230.11 |
| 3,431,568 | A * | 3/1969 | Brown | 441/3 |
| 4,040,377 | A | 8/1977 | Olsen | |
| 4,081,165 | A | 3/1978 | Fentress | |
| 4,280,440 | A | 7/1981 | Barton | |
| 4,356,783 | A | 11/1982 | Myklebust et al. | |
| 4,690,090 | A * | 9/1987 | Tuttle | 114/218 |
| 4,845,597 | A | 7/1989 | McCaghren | |
| D312,566 | S | 12/1990 | Scherer | |
| 5,036,784 | A * | 8/1991 | Wagner | 114/219 |
| 5,036,787 | A | 8/1991 | Rogers | |
| 5,154,132 | A | 10/1992 | Brushaber | |
| 5,499,591 | A | 3/1996 | Chippas | |
| 5,575,234 | A | 11/1996 | Dysarz | |
| 6,155,191 | A * | 12/2000 | Weaver | 114/218 |
| 6,561,113 | B2 | 5/2003 | Leise | |
| 6,578,509 | B1 | 6/2003 | Brushaber | |
| 6,662,740 | B1 | 12/2003 | Noe et al. | |
| D499,954 | S | 12/2004 | Brushaber | |
| 2002/0104470 | A1 * | 8/2002 | Leise | 114/230.15 |
| 2005/0016432 | A1 * | 1/2005 | Clark | 114/230.1 |

* cited by examiner

*Primary Examiner*—Ed Swinehart
(74) *Attorney, Agent, or Firm*—Jeff Klembczyk, Esq.; Kevin P. Radigan, Esq.; Heslin Rothenberg Farley & Mesiti P.C.

(57) ABSTRACT

A whip-style boat mooring apparatus, removably attachable to a standard dock cleat. The apparatus may include a second cleat, such that the apparatus provides both whip-style and standard cleat mooring from a single dock point. In one embodiment, the apparatus includes a clam-shell type housing, with a profile substantially resembling the dock cleat, such that the apparatus can be clamped to the dock cleat and prevent rotational movement. The housing may include two opposing pieces, attachable to respective sides of the dock cleat. The housing may include a rotatably adjustable means for attaching a whip socket onto the housing.

7 Claims, 4 Drawing Sheets

PORTABLE MOORING SYSTEM

TECHNICAL FIELD

The present invention relates in general to boat mooring systems, and in particular to a boat mooring system compatible with standard dock cleats, and which provides both cleat and whip-type mooring.

BACKGROUND OF THE INVENTION

Boat owners require a way to resolve two types of mooring systems usable to secure their boats. Often, only standard cleats are available on docks, but whip-type mooring is also desirable. What is required is a portable mooring system which provides both cleats and whip-type mooring.

SUMMARY OF THE INVENTION

The shortcomings of the prior art are overcome and additional advantages are provided through the present invention, referred to herein as an examplary "Portable Mooring System," which was invented to satisfy boat owners' need to dock their boats at any dock with a mooring whip set-up instead of, or in addition to, a standard cleat. This issue arises since most docks are equipped with cleats and not whip set-ups. The Portable Mooring System of the present invention accomplishes this conversion by allowing the boat owner to carry on-board a mooring kit (Portable Mooring System) that quickly and easily attaches to the traditional existing cleat normally found on docks. The Portable Mooring System, in one embodiment (e.g., FIGS. 1-2) utilizes a clam shell design that encapsulates the cleat. The fully captivated cleat provides the foundation of the mooring whip. The Portable Mooring System's mooring holder is toothed to allow various angles and adjustments. The Portable Mooring System also has an integrated cleat so as to not take away the cleat from the dock for other uses.

Advantages of a mooring whip-style docking system are that it keeps the boat away from the dock. This keeps the boat from rubbing against the dock surface during wave motions in the water. The Portable Mooring System would allow this docking method to be used on any dock that has standard cleats.

In that regard, the present invention is in one aspect a whip style boat mooring apparatus, removably attachable to a standard dock cleat. The apparatus may include a second cleat, such that the apparatus provides both whip-style and standard cleat mooring from a single dock point. In one embodiment, the apparatus includes a clam-shell type housing, with a profile substantially resembling the dock cleat, such that the apparatus can be clamped to the dock cleat and prevent rotational movement. The housing may include two opposing pieces, attachable to respective sides of the dock cleat. The housing may include a rotatably adjustable means for attaching a whip socket onto the housing.

Further, additional features and advantages are realized through the techniques of the present invention. Other embodiments and aspects of the invention are described in detail herein and are considered a part of the claimed invention.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in connection with the accompanying drawings in which:

BEST MODE FOR CARRYING OUT THE INVENTION

Figure 1:
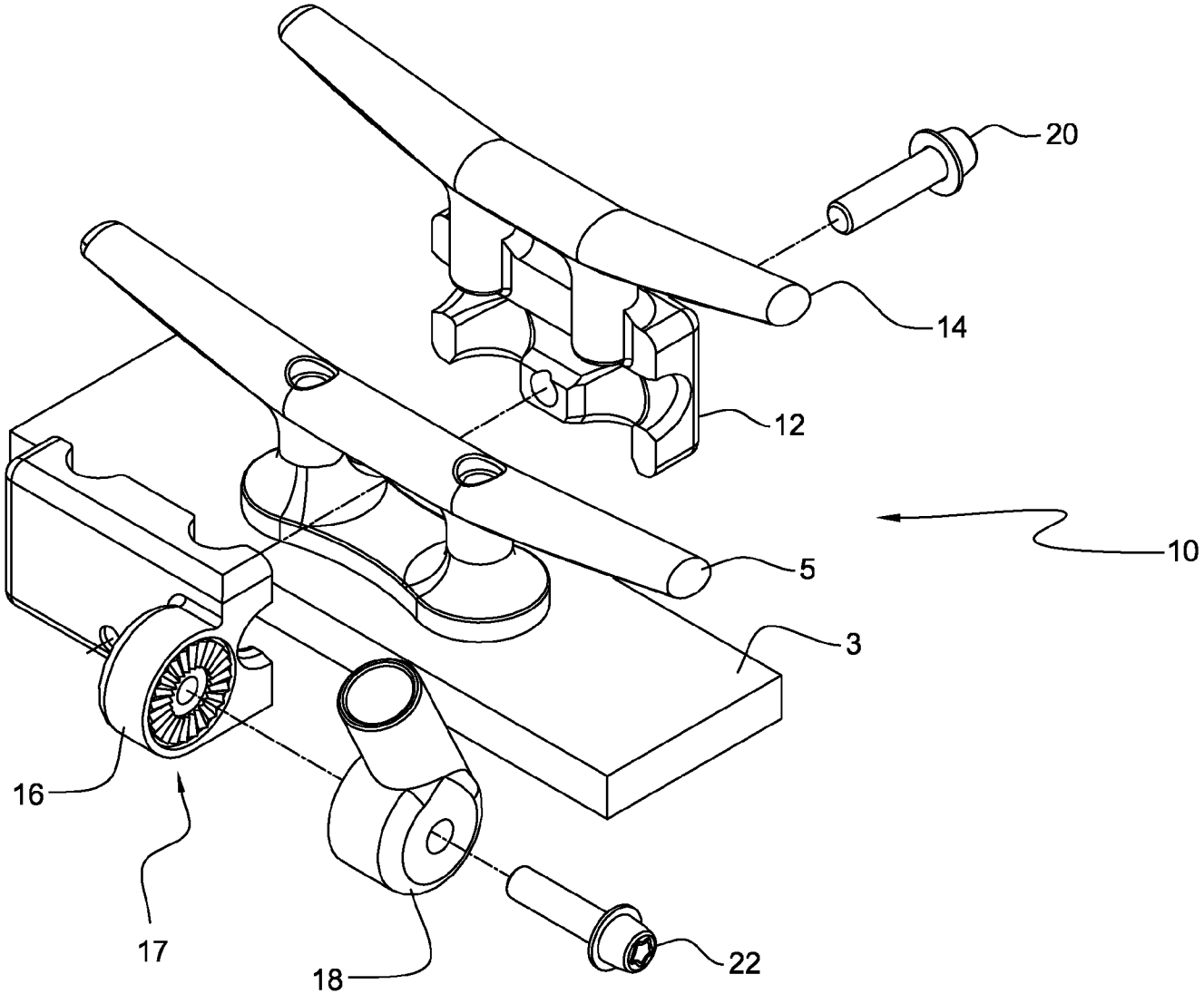
FIG. 1 is an exploded, isometric view of a portable mooring system, in accordance with a first aspect of the present invention.

In accordance with the present invention, and with reference to FIGS. 1 and 2*a-c* (where like elements are referred to using like numerals), a portable mooring apparatus 10 is shown having a clam-shell type housing comprising conformal shell piece 12 and complimentary shell piece 16. Shell pieces 14 and 16 are designed to, upon joinder using bolt 20 (FIG. 2*c*), substantially, conformally attach to a dock cleat 5 which itself is fastened to dock 3.

Shell piece 12 includes a cleat section 14 which is fastened to piece 12 or formed integrally with piece 12, and which replicates the function of cleat 5.

Shell piece 16 includes a rotatably adjustable whip socket 18 which is fastened to piece 16 using a spurred wheel 17/bolt 22 combination, or other suitable means.

Figure 2C:
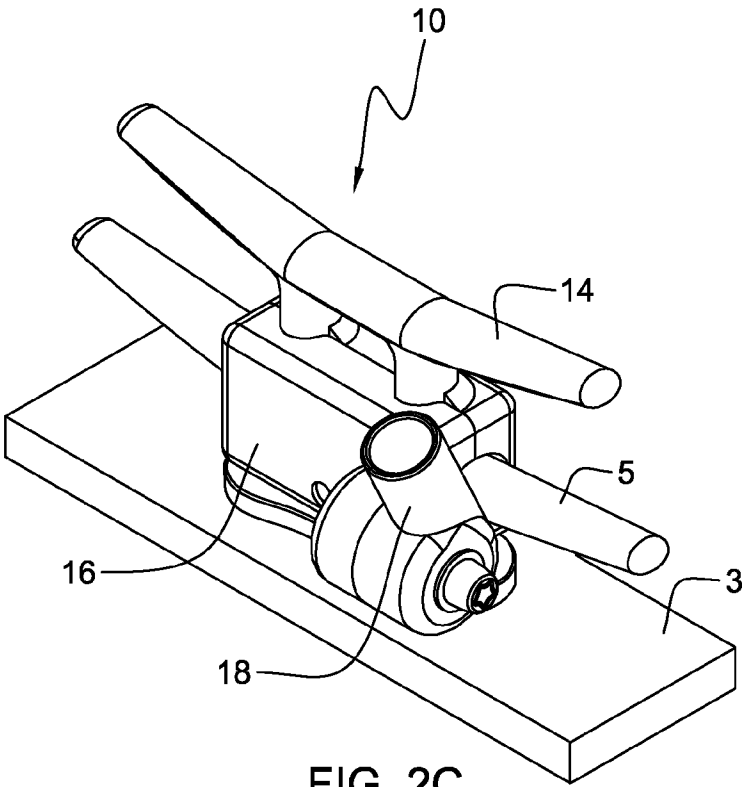
FIGS. 2*a-c* are front, top and isometric views of the portable mooring system of FIG. 1, attached to a standard cleat.
Figure 2B:
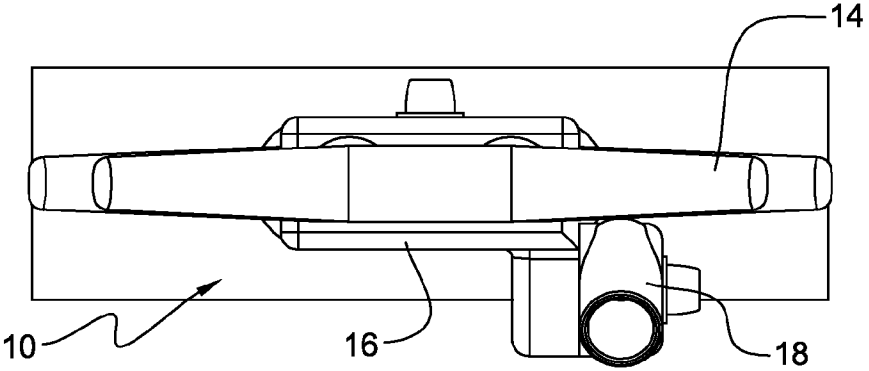
Figure 2A:
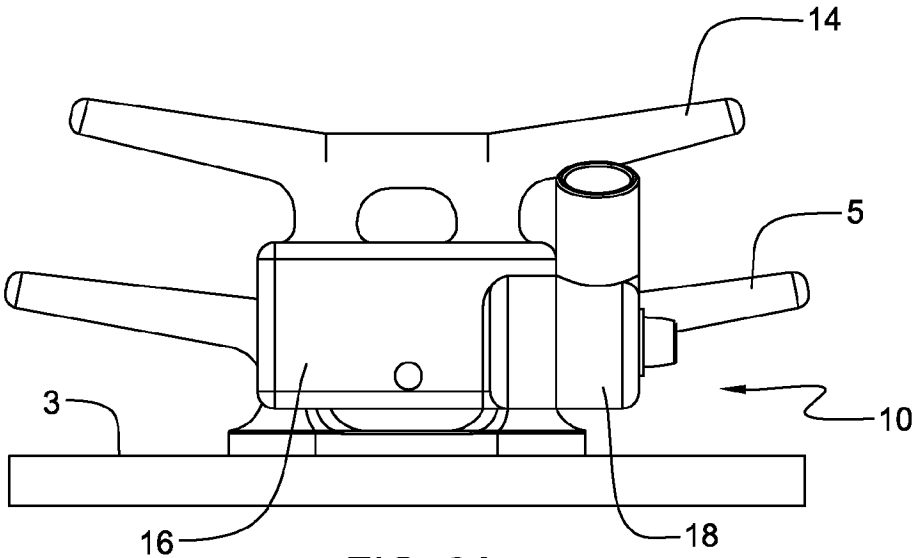
Figure 3:
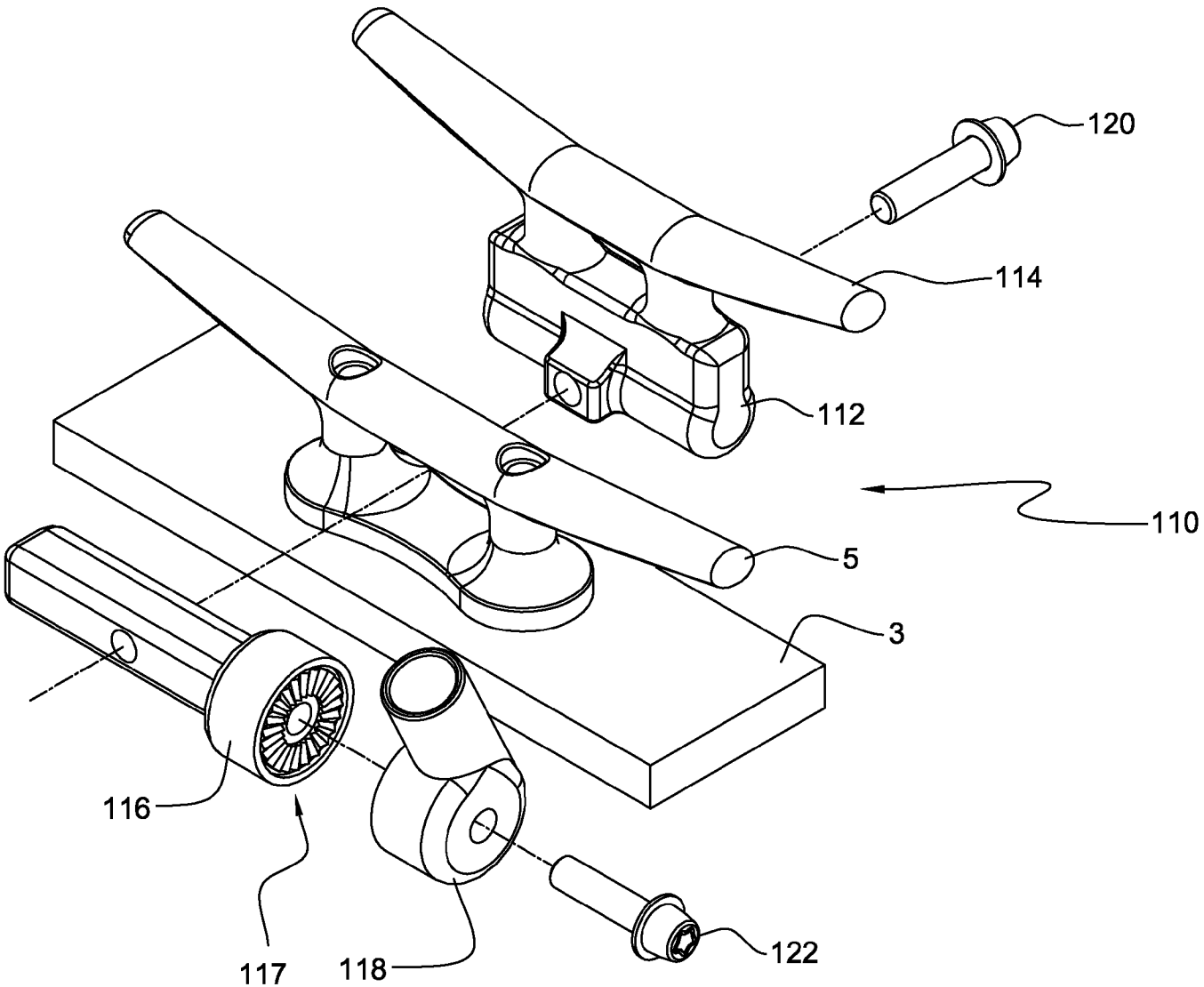
FIG. 3 is an exploded, isometric view of a portable mooring system, in accordance with a second aspect of the present invention.

As shown in FIG. 2*c*, apparatus 10 fully and conformally fastens to dock cleat 5, partially or fully emasculating the function of cleat 5, while providing a replacement cleat 14 and also a whip-style mooring using whip socket 18.

In accordance with another aspect of the present invention, and with reference to FIGS. 3 and 4*a-c* (where like elements are referred to using like numerals), a portable mooring apparatus 110 is shown having a clam-shell type housing comprising a mildly conformal shell piece 112 and attachment bar 116. Shell piece 114 and bar 116 are designed to, upon joinder using bolt 120 (FIG. 4*c*), attach to a dock cleat 5 which itself is fastened to dock 3.

Shell piece 112 includes a cleat section 114 which is fastened to piece 112 or formed integrally with piece 112, and which replicates the function of cleat 5.

Bar 116 includes a rotatably adjustable whip socket 118 which is fastened to bar 116 using a spurred wheel 117/bolt 122 combination, or other suitable means.

Figure 4C:
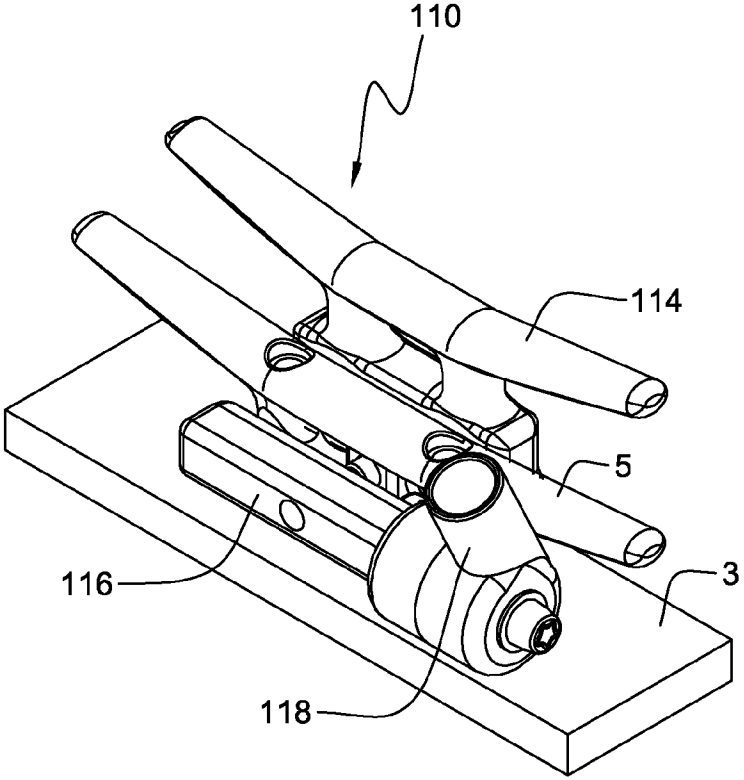
FIGS. 4*a-c* are front, top and isometric views of the portable mooring system of FIG. 3, attached to a standard cleat.
Figure 4B:
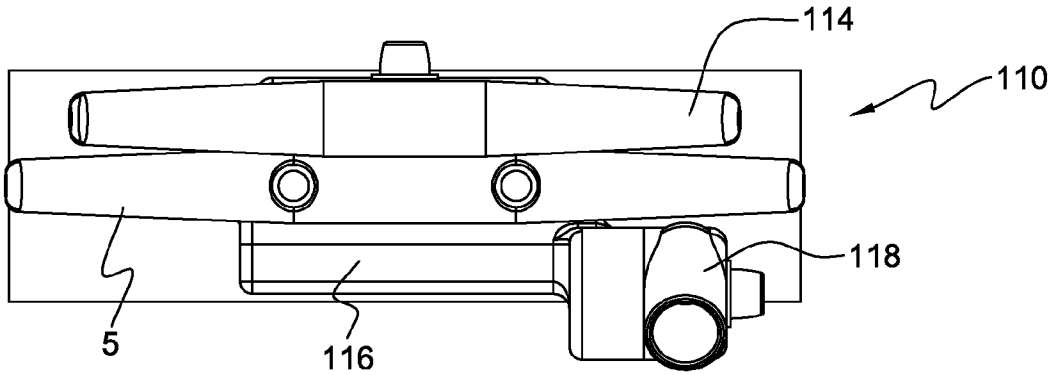
Figure 4A:
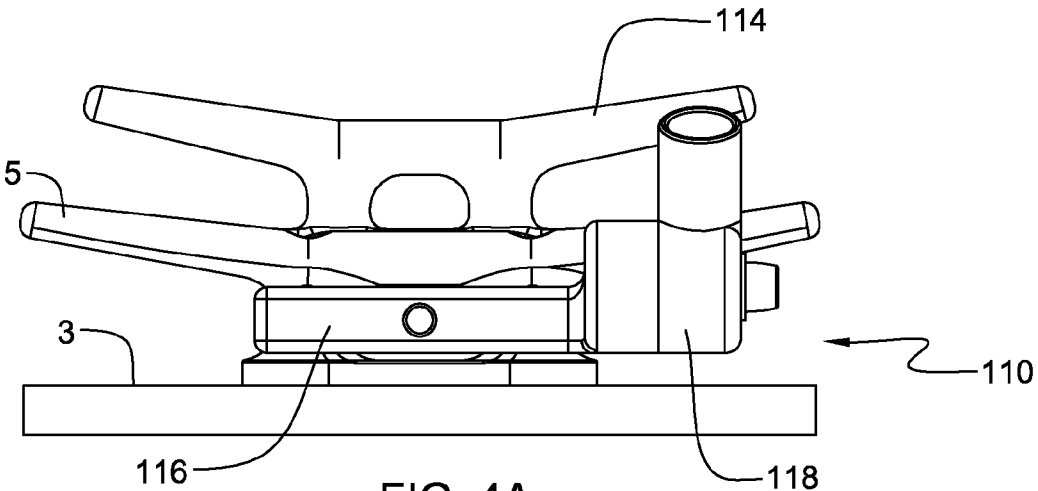

As shown in FIG. 4*c*, apparatus 110 fully and fastens to dock cleat 5, partially or fully emasculating the function of cleat 5, while providing a replacement cleat 114 and also a whip-style mooring using whip socket 118.

The conformal housing types discussed above provide an element of structural integrity in connection with the dock cleat, to fully support both whip-style and cleat mooring. Moreover, rotational adjustment of the whip socket is provided with the lockable, spurred wheel fastening apparatus discussed above.

Although preferred embodiments have been depicted and described in detail herein, it will be apparent to those skilled in the relevant art that various modifications, additions, substitutions and the like can be made without departing from the spirit of the invention and these are therefore considered to be within the scope of the invention as defined in the following claims.

What is claimed is:

1. A whip-style boat mooring apparatus including at least a whip socket for a whip which assists in positioning a boat away from the dock, the apparatus being removably attachable to a first dock cleat previously affixed to a dock but lacking a whip-style mooring capability, the first dock cleat having a central body with two oppositely projecting arms around which a dock line can be wrapped, the mooring apparatus removably attachable directly to the central body of the first dock cleat while the first dock cleat remains affixed to the dock; the apparatus further comprising:

a second cleat affixed to the apparatus above the central body of the first cleat thereby providing an alternate cleat above and proximate to the first cleat for boat mooring, the second cleat having a body and two projecting arms around which a dock line can be wrapped, such that the apparatus provides both whip-style and standard cleat mooring from a single dock point.

2. The apparatus of claim 1, comprising a clam-shell type housing, with a profile substantially resembling the central body of the first dock cleat, such that the apparatus can be clamped to the first dock cleat and prevent rotational movement.

3. The apparatus of claim 2, wherein the housing includes two opposing pieces, attachable to respective sides of the dock cleat.

4. The apparatus of claim 2, wherein the housing includes a rotatably adjustable means for attaching the whip socket onto the housing.

5. The apparatus of claim 1, comprising two opposing pieces, attachable to respective sides of the first dock cleat.

6. The apparatus of claim 5, comprising a bolt for holding the two opposing pieces together, the bolt running through an opening of the body of the first dock cleat.

7. The apparatus of claim 5, further comprising a rotatably adjustable means for attaching the whip socket onto the apparatus, attached to at least one of the two opposing pieces.

* * * * *